United States Patent [19]

Faughnan

[11] 4,303,269

[45] Dec. 1, 1981

[54] LIFTING AND MATERIAL HANDLING APPARATUS

[76] Inventor: Douglas Faughnan, 797 Edmond St., Hawkesbury, Ontario, Canada

[21] Appl. No.: 101,501

[22] Filed: Dec. 10, 1979

[51] Int. Cl.[3] ..... B66C 1/10

[52] U.S. Cl. ..... 294/86 R; 294/88

[58] Field of Search ..... 294/88, 70, 71, 86 R, 294/106, 107; 37/183 R, 184, 185, 186, 187, 188; 414/729, 739

[56] References Cited

U.S. PATENT DOCUMENTS

| | | | |
|---|---|---|---|
| 1,630,456 | 5/1927 | Wehr | 294/88 |
| 3,156,496 | 11/1964 | Davidson | 294/88 |
| 3,574,387 | 4/1971 | Hahn | 294/88 |
| 3,796,332 | 3/1974 | Kawamura | 294/88 |

*Primary Examiner*—James B. Marbert

*Attorney, Agent, or Firm*—Oblon, Fisher, Spivak, McClelland & Maier

[57] ABSTRACT

The invention relates to a lifting apparatus which can be used to handle, for example, containers, steel ingots, packages, logs, pulp, steel sheets, and so forth. It consists of a lifting arrangement, a hinge block, and lower lifting arms pivotably connected at either end of the hinge block. Adjustable tie rods connect a respective side of the lifting arrangement to a respective lower lifting arm. A lifting rod extends through both the hinge block and the lifting arrangement, and is movable relative to the upper lifting arm, and movable downward relative to the hinge block. A collar on the rod engages the bottom of the hinge block so that the hinge block moves upwardly with the lifting rod when the collar is in contact with the hinge block. A hydraulic cylinder has the top end of its piston connected to the upper lifting arm, and the bottom end of its fluid cylinder connected to the bottom end of the lifting rod, and a valve is included in the line between the hydraulic fluid reservoir and the fluid cylinder. The valve controls relative movement of the hinge block and the lifting rod to thereby control relative movement of the hinge block and the upper arm under the action of gravity and a hoisting means. The apparatus is adaptable to semi-automatic, automatic or remote control operation. In one of the embodiments, the lifting arrangement consists of an upper lifting arm which is disposed above the hinge block and extends laterally thereof. In a second embodiment, the lifting arrangement comprises vertically extending bars which are disposed on either side of the hinge block and which are attached to each other at both ends thereof.

12 Claims, 8 Drawing Figures

LIFTING AND MATERIAL HANDLING APPARATUS

BACKGROUND OF THE INVENTION

1. Field of the Invention

This invention relates to a novel lifting and material handling apparatus. More specifically, this invention relates to such apparatus which can be adapted to either semi-automatic, automatic or remote control operation.

2. Statement of the Prior Art

The prior art teaches many lifting and material handling apparatus, for example sheet lifting apparatus, as shown in U.S.A. Pat. Nos. 2,375,747, Brown, May 15, 1945; 2,732,248, Jaeger, Jan. 24, 1956; 3,044,819, Pierre, July 17, 1962; 3,198,568, Mindrum, Aug. 3, 1965; 3,854,766, Dec. 17, 1974, Jordan and 3,796,332, Kawamura, Mar. 12, 1974. Basically, the apparatus of the prior art consist of three types: The first is the low headroom type which uses a rack and pinion drive to close the grasping legs thereof. This type does not have a very powerful gripping action and can therefore be unsafe.

The second and third types use the tong principle and consist of the parallelogram type and the adjustable angle type.

The adjustable angle type has the disadvantage of requiring frequent adjustment of angles, and if the operator is careless, and does not correctly adjust the angles, safety is compromised.

Both the parallelogram type and the adjustable angle type require a hand wheel operated mechanism to open and close the legs. This mechanism requires a high ratio gear box, mechanical load brake and various linkages etc. All this apparatus is very costly and increases the dead weight of the unit. Furthermore, the operation of the hand wheel is time consuming and requires a good deal of physical effort.

SUMMARY OF THE INVENTION

It is therefore an object of the invention to provide a lifting and material handling apparatus which overcomes the disadvantages of known apparatus.

It is a more specific object of the invention to provide apparatus which features greater safety.

It is a still more specific object of the invention to provide apparatus which is adaptable to semiautomatic, automatic or remote control operation.

In accordance with the invention, a lifting apparatus, comprising: a hinge block; two lower arms extending from respective sides of the hinge block, each lower arm being pivotably attached to its respective side of the hinge block; an opening arrangement; means connecting said opening arrangement to each of said lower arms; a lifting rod for moving the hinge block relative to the opening arrangement; and means for connecting the lifting rod to either the hinge block or the opening arrangement thereby controlling the closing or opening of the lifting arms respectively under the action of gravity and a hoisting means.

In one embodiment, the opening arrangement comprises an upper opening arm disposed above said hinge block and extending laterally thereof.

In a second embodiment, said opening arrangement comprises vertically extending bars disposed on either side of said hinge block and connected to each other at the top and bottom ends thereof.

The lifting rod may extend through both said hinge block and said lifting arrangement, said opening rod being movable relative to said opening arrangement and movable relative to said hinge block; and means on said lifting rod for engaging the bottom of said hinge block; whereby, when said means for engaging contacts the bottom of said hinge block, said hinge block will move upwardly with said lifting rod.

The means for connecting the lifting rod may comprise a hydraulic cylinder having a piston slidably disposed in a fluid cylinder; the top end of said piston being fixed to said upper lifting arm; the bottom end of said fluid cylinder being fixed to the bottom end of said lifting rod.

The means connecting may comprise two adjustable tie rods, each tie rod being pivotably connected, at one end thereof, to a respective side of the upper lifting arm, and, at the other end thereof, to a respective lower lifting arm.

The apparatus may further comprise a hydraulic fluid reservoir; means connecting said fluid reservoir with said fluid cylinder; and valve means in said means connecting said fluid reservoir with said fluid cylinder to permit or prevent hydraulic fluid from flowing between said fluid cylinder and said reservoir.

BRIEF DESCRIPTION OF THE DRAWINGS

The invention will be better understood by an examination of the following description, together with the accompanying drawings, in which.

DETAILED DESCRIPTION OF THE DRAWINGS

Figure 1:
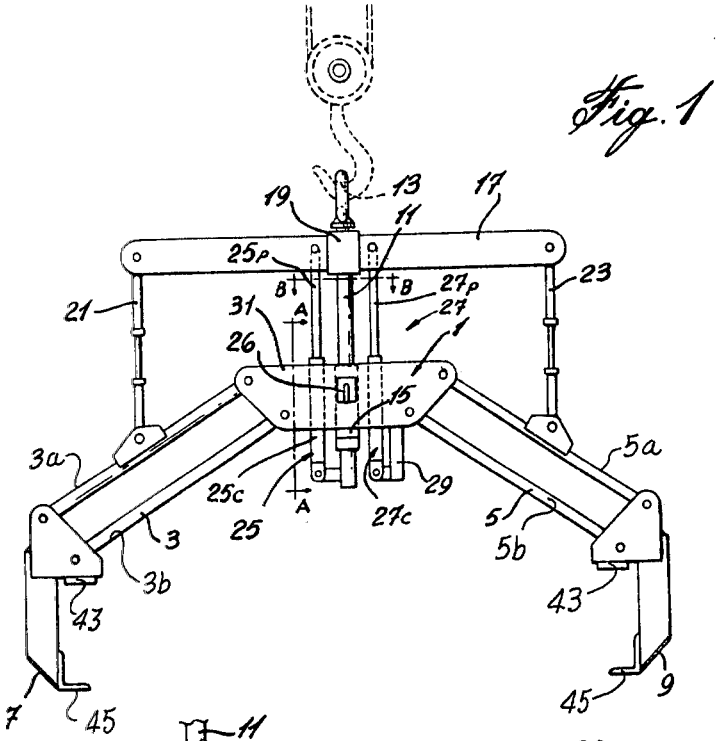
FIG. 1 illustrates one embodiment of the apparatus in its transport position.

Referring to FIG. 1, the apparatus in accordance with the invention comprises a hinge block 1 having lower arms 3 and 5 pivotably attached at respective sides thereof. Load grasping means, such as lifting legs 7 and 9, are pivotably attached to the respective free ends of the lower arms. In this particular embodiment, the arms 3 and 5 consist, respectively, of two slat-like members 3*a*, 3*b*, and 5*a*, 5*b*. It will, of course, be appreciated that other forms for these arms are possible.

A lifting rod 11 extends through the hinge block 1 so as to be movable relative to the hinge block, as will be discussed below, and terminates, at its top end, in an attachment ring 13. The ring can be connected to, for example, the hook of a crane, as shown in dotted lines in FIGS. 1, 2 and 3 and as well known in the art. The bottom end of the lifting rod includes a fixed collar 15, in physical engagement with the bottom of the hinge block, whereby, when the lifting rod is moved upwardly, and the collar contacts the hinge block, the hinge block will move with it.

Disposed above the hinge block is an arrangement for opening the lifting arms, in this embodiment, laterally extending upper bar 17, having a collar 19 disposed centrally thereof. The lifting rod 11 extends through the collar 19, and is movable relative to the collar 19. Extending from either side of the bar 17 are arm tie rods 21 and 23, the tie rods being pivotably attached, at one end thereof, to the respective sides of the upper bar, each tie rod being pivotably attached, at the other ends thereof, to a respective lower arm.

Also extending through the hinge block are hydraulic cylinders 25 and 27. Hydraulic cylinder 25 includes piston 25*p*, whose top end is attached to the upper bar 17, and fluid cylinder 25*c*, whose lower end is attached to the lower end of the lifting rod 11. As the cylinder 25 is not attached to the hinge block, it is movable relative to the hinge block. Hydraulic cylinder 27 similarly includes piston 27*p*, which is also attached, at the top end thereof, to the upper bar 17, and fluid cylinder 27*c*, which is attached, at the lower end thereof and through member 29, to the bottom of the hinge block.

Figure 4:
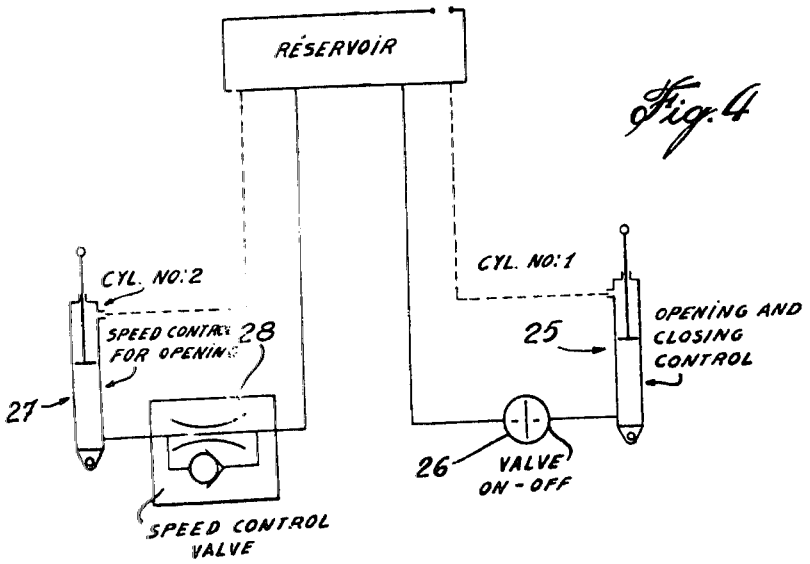
FIG. 4 is a hydraulic circuit diagram of the hydraulic valves.

As can be seen in FIG. 4, hydraulic cylinder 25 is controlled by ON/OFF and speed control valve 26 (also seen in FIG. 1) while hydraulic valve 27 is controlled by speed control valve 28. Hydraulic cylinder 27 is not a necessary part of the apparatus in accordance with the invention, but is included in a preferred embodiment of the invention to control the speed of the leg movement as will be discussed below.

Figure 1A:
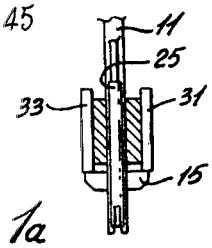
FIG. 1A is a section through A—A of FIG. 1.
Figure 1B:
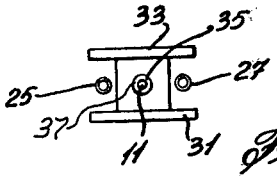
FIG. 1B is a section through B—B of FIG. 1.

To better understand the construction of the hinge block in accordance with the illustrated embodiment, attention is directed to FIGS. 1A and 1B. As can be seen in these Figures, the hinge block comprises plates 31 and 33. Disposed between the plates is a block 35 having a cylindrical opening 37 for receiving lifting rod 11. The diameter of 37 is, of course, greater than the diameter of the lifting rod. It will, of course, be appreciated that this is only one construction of the hinge block, and there are many other alternatives for example a solid block with three openings to receive, respectively, the rod 11 and the cylinders 25 and 27, all of which are within the knowledge of one skilled in the art.

Tie rods 21 and 23 are adjustable to adjust the opening and closing extents of the arms 3 and 5. However, they are fixed in length during the operation of the apparatus.

In operation, the apparatus works as follows:

With the apparatus suspended from a hoist by ring 13 and the pistons 25 and 27 in their fully extended position, and valve 26 closed, the arms 3 and 5 are in the fully open position as shown in FIG. 1. Under the action of gravity, hinge block 1 will remain in the fully down position so that lower arms 3 and 5 will remain fixed in their fully open position. When a lifting force is applied at 13, it will be transmitted, through rod 11, to collar 15. Thus, the lifting force will be applied to the bottom of hinge block 1 which will move upward carrying with it the remainder of the apparatus.

Figure 2:
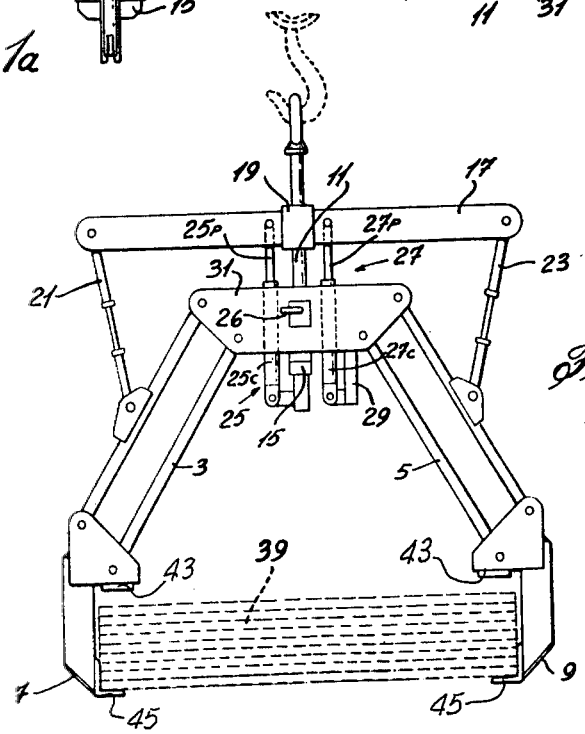
FIG. 2 illustrates the apparatus of FIG. 1 in its load gripping position.

The apparatus is so carried till it is over the load to be lifted, and it is then lowered over the load. The valve 26 is then opened, so that hydraulic fluid is free to flow out of fluid cylinder 25*c*. The weight of arms 3 and 5 and legs 7 and 9 and upper bar 17 and tie rods 21 and 23 will cause the free ends of the arms 3 and 5 to move downwardly, so that legs 7 and 9 move towards each other. This motion will continue until the legs grasp the bottom of the load to be lifted 39 as shown in FIG. 2. The load can now be hoisted, and it will remain secure in the grasp of the legs due to the force of gravity alone. It is especially noted that valve 26 can remain open during hoisting. It will be seen that the natural force of gravity prevents the arms 3 and 5 from opening to thereby provide the required safety feature without the necessity of a manual or mechanical safety step which could easily be forgotten.

Figure 3:
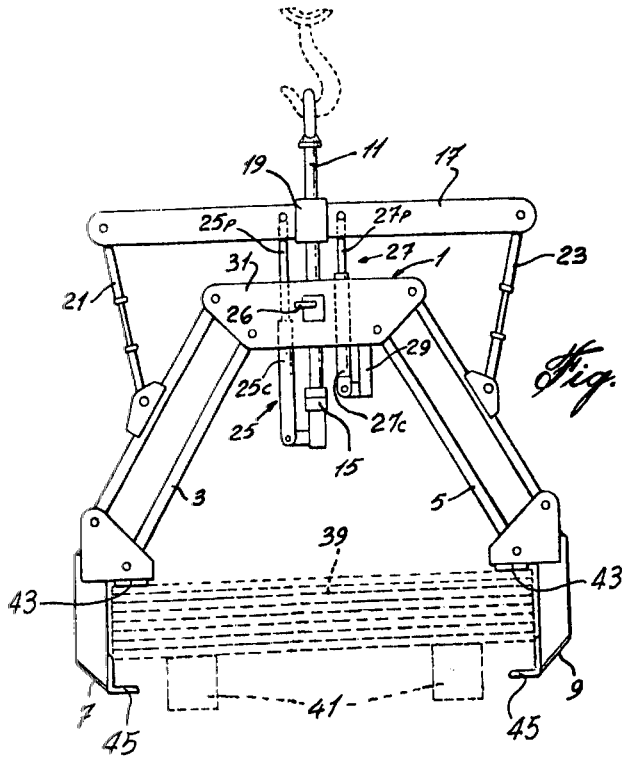
FIG. 3 illustrates the apparatus of FIG. 1 in its load release position.

To release the load, the apparatus is lowered so that the load rests on the skids 41 shown in FIG. 3 and the pads 43 of the grasping means rest on the top of the load, or the bottoms 45 of the grasping means rest on a surface. Further lowering of the crane hook (shown in dotted lines), will force the lifting rod 11 downwardly. As the bottom end of fluid cylinder 25*c* is attached to the bottom end of lifting rod 11, the cylinder 25*c* will follow the motion of 11, and hydraulic fluid will be drawn into the cylinder as the valve 26 is open. The valve 26 is closed when the lifting rod has moved downward a sufficient amount, and closing the valve will lock the lifting rod with the upper bar 17. This is the situation as illustrated in FIG. 3.

We will now consider the operation of the apparatus when the crane hook is lifted. In the first instance, we will consider the operation of the apparatus without hydraulic cylinder 27 in the circuit.

When the crane hook is lifted, pads 43 will be lifted off the load or bottoms 45 will be lifted off the ground. By action of gravity, the hinge block 1 will begin to fall downward, thus spreading legs 3 and 5 apart and away from each other until they take up the position as shown in FIG. 1. It can thus be seen that hydraulic cylinder 27 is not essential for the operation of the invention and could be considered an inventive improvement of the invention herein.

With hydraulic cylinder 27 in the system, and considering the circuit diagram of FIG. 4, it can be seen that hydraulic cylinder 27 controls the rate at which the hinge block 1 moves downwardly. More accurately, the rate at which the hinge block moves downwardly is determined by the rate at which control valve 28 permits hydraulic fluid to be withdrawn from the top of cylinder 27*c*.

Figure 5:
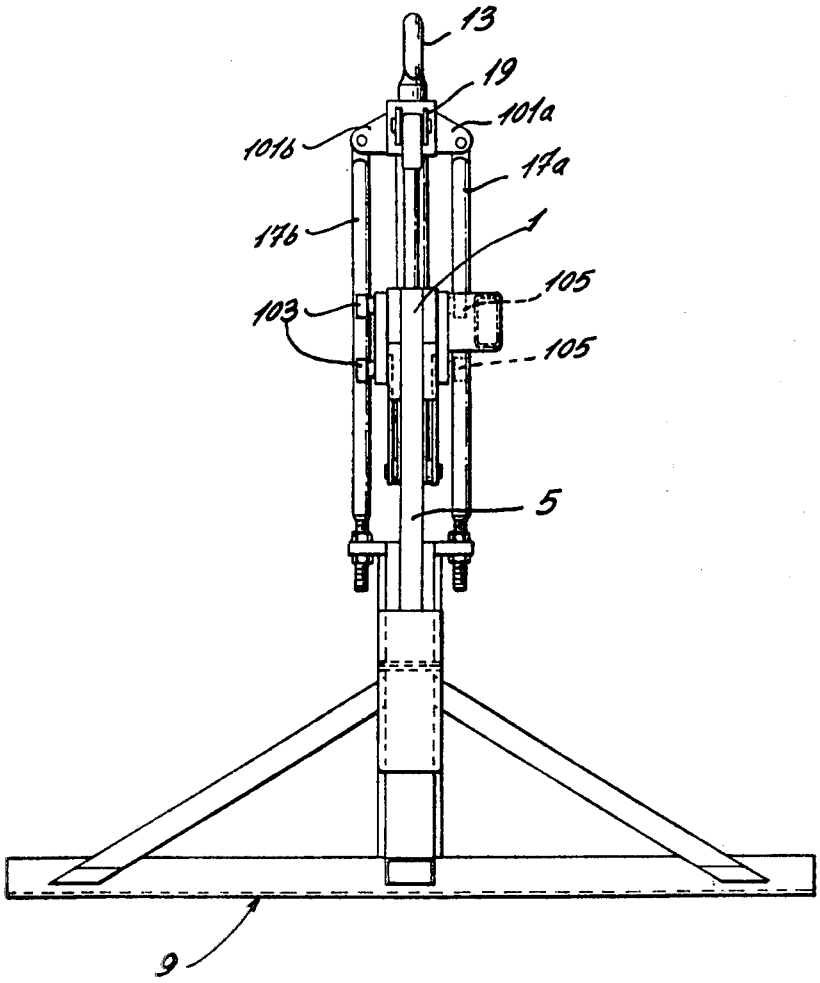
FIG. 5 illustrates a second embodiment of the apparatus in its transport position.
Figure 6:
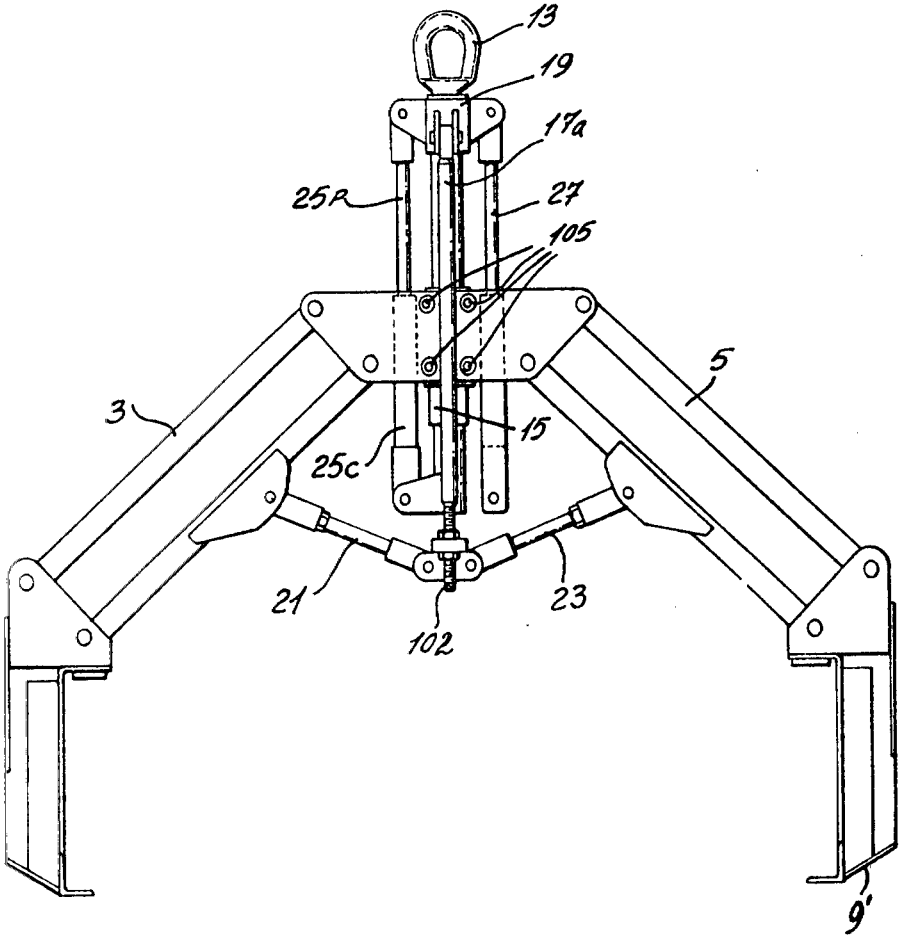
FIG. 6 is a side view of FIG. 5.

Referring now to FIGS. 5 and 6, like references in these Figures refer to the same parts as referred to in FIGS. 1 to 4. As can be seen, the embodiments in FIGS. 5 and 6 are identical to the embodiments in FIGS. 1 to 4 except that, instead of having the arrangement for opening the lifting arms comprising a laterally extending upper opening bar 17, in the FIGS. 5 and 6 embodiments, the arrangement for opening the lifting arms comprises vertically extending bars 17*a* and 17*b*. The bars 17*a* and 17*b* extend on either side of the hinge 1 and are centrally located. The bars are connected to the collar 19 by means 101*a* and 101*b* at the top ends of 17*a* and 17*b* respectively, and the bottom ends of 17*a* and 17*b* are connected to each other by means 103. The arm tie rods 21 and 23 are once again connected, respectively, to arms 3 and 5, however, in this embodiment, the tie rods 21 and 23 are connected to the bottoms of the arms 5 and 7 instead of the tops. The other ends of the tie rods are connected to means 102. Thus, once again, the tie rods will be moved together with the arrangement for raising and lifting the arms, namely, the bars 17*a* and 17*b*. As will be obvious, the arms 17*a* and 17*b* will be moved together.

As also seen in FIGS. 5 and 6, the apparatus in this embodiment includes two pairs of rollers 103 disposed on either sides of FIG. 17*b*, and two pairs of rollers 105 disposed on either side of bar 17*a*. These are guide rollers which equalize the opening angle of the arms as they guide the bars 17*a* and 17*b* in a straight path.

The operation of the FIGS. 5 and 6 embodiments is identical to the operation of the previous embodiment as above described except that, when the bars 17*a* and 17*b* are moved upwardly, then the arms 3 and 5 are pushed upwardly instead of being pulled upwardly. In all other respects, the operation of the second embodiment is identical to the operation of the first embodiment.

The apparatus may be converted for fully automatic operation by the addition of a valve actuator for, or in place of, valve 26. The actuator would sense suitable positions of the lifting cycle and open and close automatically in response to the respective stimulus.

Remote operation of the apparatus would be made possible by use of a solenoid valve or a radio controlled valve actuator for, or in place of, valve 26. Remote control of valves is well known in the art so that further description of such a conversion facility is not necessary.

As above noted, the apparatus is absolutely fail-safe in operation since the weight of the lifted load causes a powerful gripping action of the legs based on the tong principle. Once the load is lifted, and firmly gripped by the lifting legs 7 and 9, operation of valve 26 has no effect. Thus, it is impossible to release the load without first lowering it onto a rest so that the weight of the load is taken off the crane.

Although one embodiment has been above-described, this was for the purpose of describing, but not limiting, the invention. Various modifications, which will come readily to the mind of one skilled in the art, are within the scope of the invention as defined in the appended claims.

I claim:

1. A lifting apparatus comprising:

a hinge block;

two lower arms extending from respective sides of the hinge block, each lower arm being pivotably connected to its respective side of the hinge block;

an opening arrangement including two rod-like means, each rod-like means being pivotably connected to a different one of said lower arms and arranged to either uniformly lift said lower arms, whereby to open said lower arms, or to lower said lower arms, whereby to close said lower arms;

a lifting rod having an attachment ring at the top end thereof, said lifting rod extending through both said opening arrangement and said hinge block;

means for connecting having three connecting positions, said means for connecting, in said first connecting position, connecting said lifting rod to said opening arrangement and, in said second connecting position, connecting said lifting rod to said hinge block, and, in the third connecting position, connecting both said hinge block and said opening arrangement to said lifting rod;

wherein, when said means for connecting is in said first position, said lower arms will open upon application of an upward force at said attachment ring due only to the action of gravity on said hinge block; and wherein, when said means for connecting is in said second position, said lower arms will close due only to the action of gravity on said lower arms; and wherein, when said means for connecting is in said third position, and said lower arms are open, said lower arms will remain open.

2. Apparatus as defined in claim 1 wherein said lifting rod extends through both said hinge block and said lifting arrangement, said opening rod being movable relative to said opening arrangement and movable relative to said hinge block; and means on said lifting rod for engaging the bottom of said hinge block;

whereby, when said means for engaging contacts the bottom of said hinge block, said hinge block will move upwardly with said lifting rod.

3. Apparatus as defined in claim 2 wherein said means for connecting comprises a hydraulic cylinder having a piston slidably disposed in a fluid cylinder;

the top end of said piston being fixed to said opening arrangement:

the bottom end of said fluid cylinder being fixed to the bottom end of said lifting rod.

4. Apparatus as defined in claim 1 wherein said means for connecting comprises two adjustable tie rods, each tie rod being pivotably connected, at one end thereof, to a respective side of the opening arrangement, and, at the other end thereof, to a respective lower lifting arm.

5. Apparatus as defined in claim 1 and further comprising lifting legs disposed at the free ends of said lower arms.

6. Apparatus as defined in claim 3 and comprising a hydraulic fluid reservoir;

means connecting said fluid reservoir with said fluid cylinder;

and valve means in said means connecting said fluid reservoir with said fluid cylinder to permit or prevent hydraulic fluid from flowing between said fluid cylinder and said reservoir, and also control rate of flow.

7. Apparatus as defined in claim 3 and further comprising a second hydraulic cylinder having a piston and fluid cylinder;

the top end of the piston of said second hydraulic cylinder being fixed to said upper lifting arm;

the bottom end of said fluid cylinder of said second hydraulic cylinder being fixed to the bottom of said hinge block;

the speed of movement of said piston of said second hydraulic cylinder into the fluid cylinder of said second hydraulic cylinder being controlled by a speed control valve.

8. Apparatus as defined in claim 6 including valve actuator means for automatically actuating said valve means under predetermined conditions;

whereby said apparatus operates fully automatically.

9. Apparatus as defined in claim 6 wherein said valve means is remotely controllable;

whereby said apparatus is remotely controllable.

10. Apparatus as defined in claim 3 wherein said opening arrangement comprises an elongated upper opening arm;

said upper opening arm being disposed above said hinge block and extending laterally thereof.

11. Apparatus as defined in claim 10 wherein said rod-like means comprises tie rods pivotally connected at each end of said upper opening arm, a respective tie rod being connected to a respective lower arm.

12. Apparatus as defined in claim 3 wherein said lifting arrangement comprises vertically extending bars disposed on either side of said hinge block;

said vertically extending bars being connected, at the top end thereof, to the top end of said piston;

said vertically extending bars being connected, at the bottom ends thereof, to two adjustable tie rods, each of said tie rods being pivotably connected, at the free ends thereof, to a respective lower lifting arm.

* * * * *